United States Patent [19]

Fister

[11] Patent Number: 4,575,049

[45] Date of Patent: Mar. 11, 1986

[54] STAPLE REMOVER AND METHOD OF REMOVING STAPLES

[75] Inventor: Christian Fister, Lyons, France

[73] Assignee: AFSAL Sarl, Paray-le-Monial, France

[21] Appl. No.: 600,330

[22] Filed: Apr. 13, 1984

[30] Foreign Application Priority Data

Apr. 14, 1983 [FR] France ..... 83 06329

[51] Int. Cl.[4] ..... B25C 11/00

[52] U.S. Cl. ..... 254/28; 81/310

[58] Field of Search ..... 254/28; 81/5.1 R, 302, 81/308, 310

[56] References Cited

U.S. PATENT DOCUMENTS 2,481,647 9/1949 De Generes .
2,750,148 6/1956 Burbank .
2,762,604 9/1956 Misson ..... 254/28
4,293,119 10/1981 Diederichs .

FOREIGN PATENT DOCUMENTS 1077634 3/1960 Fed. Rep. of Germany .
2458361 1/1981 France .

*Primary Examiner*—Frederick R. Schmidt
*Assistant Examiner*—Judy J. Hartman
*Attorney, Agent, or Firm*—Sandler & Greenblum

[57] ABSTRACT

A tool which may be used to remove staples having a first and second pivotably connected elements having parallel, spaced-apart members, the second of which is at least partially disposed in the first and has a tongue with a removable concave, bevelled tip and is pivotably connected to a lever and a gripping bar which is parallelpipedic with an S-shape having a striated, convex lower end which is spring biased into contact with each other so that when the tongue is inserted under the head of the staple and a pressure exerted on the lever it causes the means for gripping to pivot until its convex end comes into contact with the head of the staple which is pinched against the tongue and removed without being deformed.

18 Claims, 4 Drawing Figures

STAPLE REMOVER AND METHOD OF REMOVING STAPLES

BACKGROUND OF THE INVENTION

1. Field of the Invention

The present invention relates to a tool which serves to remove staples which are used, not exclusively but for example, to attach sheets of paper together, assemble cardboard packages, or attach wall coverings. The apparatus of the invention comprises a tongue which slides under the head of the staple and an element which pinches or otherwise grips it to prevent the staple from sliding laterally.

2. Description of Pertinent Materials and Background Information

U.S. Pat. No. 4,293,119 describes a narrow pincer or pliers which removes staples utilizing a claw bar which is supported on one of its jaws, specifically the jaw which serves as the lever arm. The staple is not laterally guided during its extraction. Moreover, if one does not have a support surface for the lever, the staple cannot be removed. Furthermore, the extraction of the staple by a pincer as narrow as this pincer necessarily causes the deformation of the head of the staple which tends to bend under the force which is directed between the two legs of the staple, which oppose the extraction effort being exerted.

U.S. Pat. No. 2,481,647 describes a staple remover which comprises a first tongue which is integral with a fixed handle and a second tongue integral with a journalled handle. The second tongue is slid under the head of the staple and pinched by the two spring flaps integral with the fixed handle. The pinching flaps are integral with the fixed handle and rest on the edges of the head of the staple, while the extraction tongue acts at the center. Despite the lateral guidance made possible by the first pair of tongues inserted under the staple, this arrangement does not prevent the deformation of the staple and its poor extraction. In this regard, they do not prevent the head of the staple from deforming or from becoming extracted from only one side. Furthermore, it is noted that the two flaps which retain the head of the staple serve only for maintenance purposes.

SUMMARY OF THE INVENTION

An object of the present invention is a tool including a fixed element, a second element having an end portion with a tongue, a first pivot operatively connecting the second element to the first element, a lever, a second pivot operatively connecting the lever to the second element, a means for gripping, and a third pivot operatively connecting a means for gripping to the second element.

Other objects of the invention include the provision of tools similar to the above-described tool wherein either the first or second elements include parallel, spaced-apart members.

A further object of the present invention is such a tool wherein the parallel members of the first element taper in a forward direction to form nose portions.

Another object of the invention is such a tool wherein the second element is at least partially disposed within and operably connected by a pivot to the first element.

Yet another object of the invention is a tool wherein the tongue has a tip which is bevelled as well as concave and may be removable from the second element.

A still further object of the present invention is the provision of the tool wherein the means for gripping is parallelpipedic, preferably S-shaped have a convex lower end which may be striated.

Another object of the present invention is a tool as previously described having at least one spring with ends which wind around a first pivot wherein one end of the spring contacts or presses against the lever, thereby biasing the lever against a means for connecting with the other end of the spring supported by a rear base portion of the first element, thereby biasing the lever against the means for gripping.

A further object of the present invention is the provision of a tool having at least one spring having ends and winding around the first pivot, wherein an end of the spring contacts a means for gripping and the other end of the spring is supported by a portion of the first element, whereby the means for gripping is biased against the lever.

A still further object of the present invention is the provision of a tool which includes two springs wherein the second spring is stronger than the first spring, and the end of the first spring presses against the lever and the other end of the first spring is supported by the rear portion of the first element, thereby biasing the lever against the means for gripping, and an end of the second spring presses against the means for gripping and the other end of the second spring is supported by the front portion of the first element thereby biasing the means for gripping against the lever.

BRIEF DESCRIPTION OF THE DRAWINGS

The invention will now be described with reference to the annexed drawings given by way of non-limiting example only in which.

DESCRIPTION OF THE PREFERRED EMBODIMENTS

Figures 1, 2:
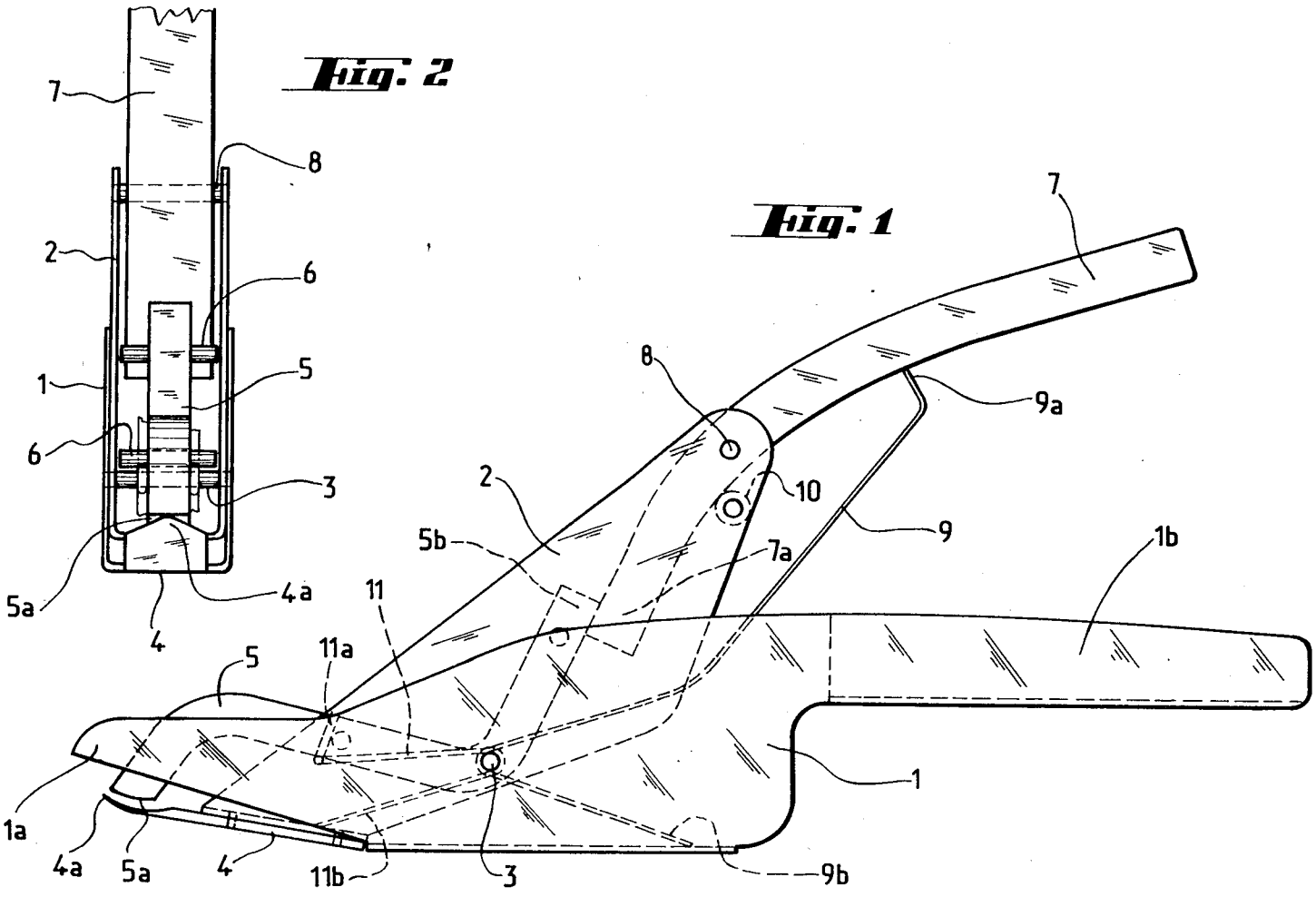
FIG. 1 illustrates an elevational view of a staple remover according to the present invention.
FIG. 2 is a side view of the apparatus of the invention.
Figure 3:
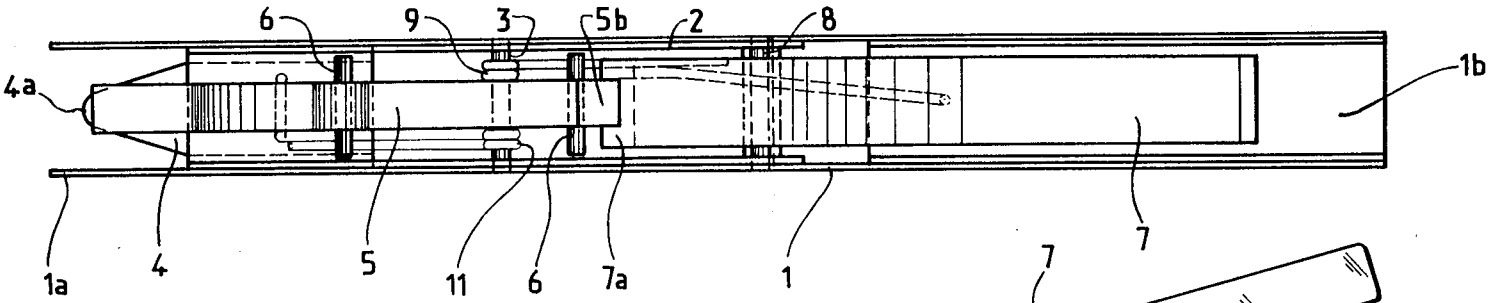
FIG. 3 is a top planer view of the device of the invention.

The staple remover according to the present invention makes it possible to overcome the disadvantages of prior art apparatus referred to above. The remover according to the invention is characterized by the fact that it comprises a first cap or cover including a handle. A second cap or cover is journalled in the first cap and includes an integral extraction tongue. A manipulation lever of a pinching element for a staple is journalled in the second cap. An axis or pivot permits pivotal movement of the manipulation lever of the pinching element before the extraction of the staple, while another axis or pivot permits the simultaneous pivotal movement of the pinching element and of the cap or cover carrying the tongue for the extraction of the staple. Thus, the greater the extraction force exerted on the lever, the more the pinching force is increased on the staple.

The advantage of the staple remover according to the invention resides in the fact that the pinching element for the staple locks the staple against the tongue before beginning the extraction process. This avoids a lateral sliding of the staple and allows for the removal of its two flaps or legs of the staple at the same time.

Referring to the drawings, the staple remover according to the invention comprises a first elongate element or cap 1 which extends forwardly as parallel members or wings having space therebetween which taper to form two nose portions 1*a* spaced apart without a bottom. Cap 1 extends rearwardly to form a handle 1*b*.

In the space between the parallel wings of cap 1, a second cap or elongate element 2 is provided which is journalled on a first pivot or axis 3 which extends through both cap 1 and cap 2 and can comprise a head and a retention screw (not shown).

A removable tongue, generally indicated as 4*a*, extending between the nose portions 1*a*, is positioned at the forward end of cap 2 and is applied and attached to removable flap 4. End or tip 4*a* is bevelled to facilitate its introduction under the staple.

On a first pivot or axis 3 a pinching bar or means for gripping, shown as element 5, having a "S" shape, is formed of a parallelpipedic bar which oscillates. This arrangement includes centering reinforcements 6 between the wings of cap 2.

Between the parallel members or wings of cap 2, a lever 7 is provided which is journalled on a second pivot or axis 8 which extends therethrough. The second pivot or axis 8 can comprise a head and retention screw (not shown).

As may be seen with reference to FIG. 1, the lower end 7*a* of lever 7 rests against or is otherwise associated with end 5*b* of pinching bar 5. The other end 5*a* of pinching bar 5, which pinches staple A, is positioned to face the end 4*a* of tongue 4 which is shown as being slightly curved. For this purpose, end surface 5*a* of the bar is convex and striated.

A first spring 9 biases lever 7 against abutment 10 which is positioned as a means for connecting the two wings or parallel members of cap 2. This spring winds around axis or pivot 3 and one of its ends 9*a* rests or presses against the lever while its other end 9*b* abuts or is supported by the rear portion or end of cap 1.

A second spring 11, less powerful than the preceding spring 9, returns end 5*b* of S-shaped bar 5 against the end 7*a* of lever 7. This spring winds around axis 3 and one of its ends 11*a* is attached to or otherwise associated with S-shaped bar 5 while its other end 11*b* rests against or is supported by the front portion or end of cap 2.

To remove a staple by means of the apparatus which has just been described, one need only engage tongue 4 under the head of the staple and then exert a pressure on lever 7 which, by oscillating around axis or pivot 8, pivots S-shaped bar 5 around axis or pivot 3 until the convex end 5*a* of bar 5 comes into contact with the head of staple A which is thus pinched against tongue 4.

Continuing the action on lever 7, elongate element or cap 2 oscillates in turn in cap 1 around axis or pivot 3 which, as a result of its movement, causes the tongue to engage under the head of staple A and to be locked by the end 5*a* of the S-shaped bar 5.

Figure 4:
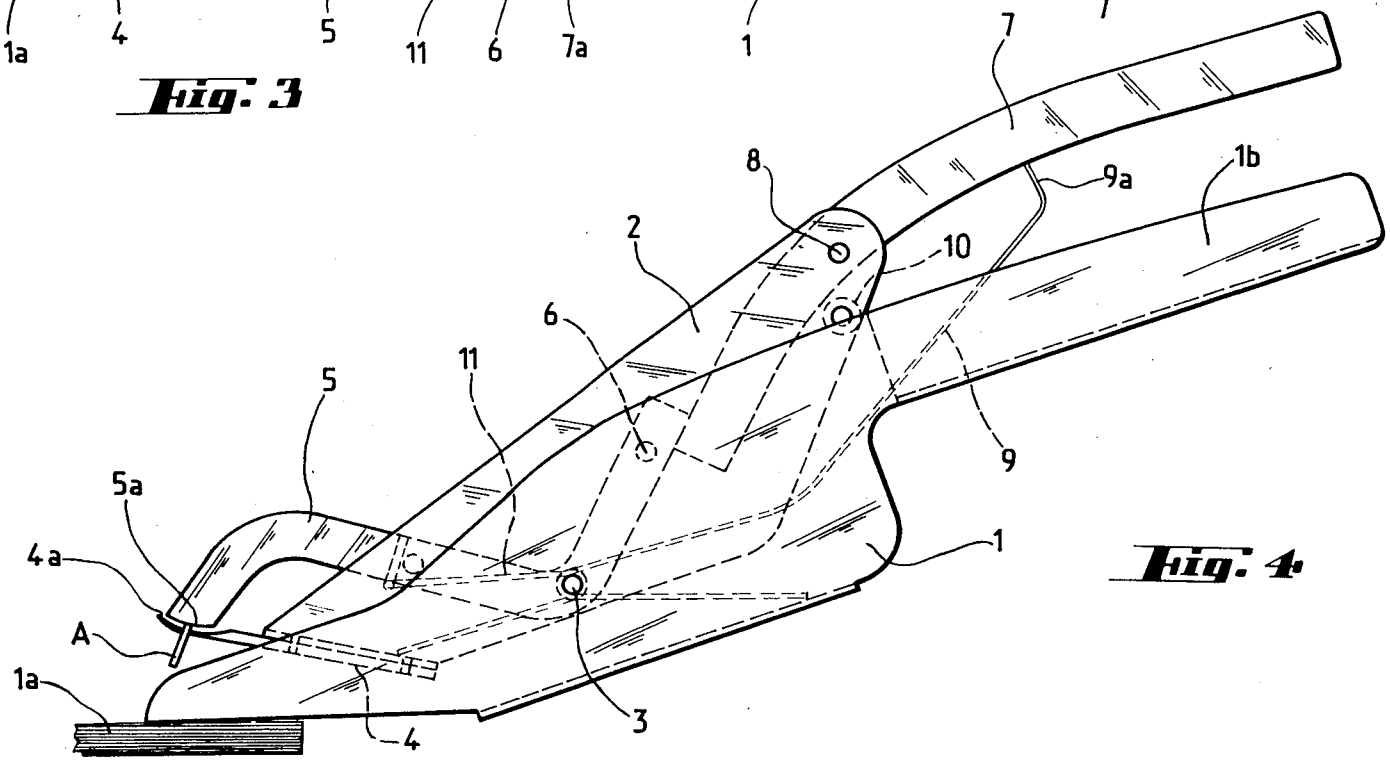
FIG. 4 illustrates the tool in a staple removing position.

As may be clearly seen in FIG. 4, the staple is thus removed without being deformed and its two legs or flaps are extracted at the same time.

It may be seen that the pressure on lever 7 occurs against the inverse force which is exerted by the two noses 1*a* of cap 1 which form a knob, resting on the support of the staple, whether the staple is wide or narrow.

By virtue of lever 7 which simultaneously moves pinching bar 5 and extraction tongue 4, the greater the force exerted on the lever, the greater the increase of pinching force between tongue 4 and bar 5 on staple A. One can thus unstaple thicknesses of paper or carton of greater than 10 mm without effort and without causing the deformation of the staple.

Although the invention has been described with reference to particular means, materials and embodiments, it is to be understood that the invention is not limited to the particulars disclosed and extends to all equipments within the scope of the claims.

I claim:

1. A tool comprising:

(a) a first element having a front portion and a rear portion;

(b) a second element having an end portion with a tongue, said second element being operably connected to said first element by a first pivot;

(c) a lever operably connected to said second element by a second pivot;

(d) a means for gripping operably connected to said second element by said first pivot, said means for gripping being in contact with said lever; and (e) a first spring and a second spring bent around said first pivot, said second spring being stronger than said first spring, so that an end of the first spring presses against said lever and another end of the first spring is supported by said rear portion so as to bias said lever against said means for gripping, and an end of the second spring presses against said means for gripping and another end of the second spring is supported by the front base portion so as to bias said means for gripping against said lever.

2. The tool in accordance with claim 1 wherein said first element comprises parallel spaced-apart members.

3. The tool in accordance with claim 2 wherein said second element comprises parallel spaced-apart members.

4. The tool in accordance with claim 2 wherein said second element is at least partially disposed between the parallel members of said first element.

5. The tool in accordance with claim 2 wherein the parallel members of said first element taper in a forward direction.

6. The tool in accordance with claim 1 wherein said tongue has a tip and said tip is bevelled.

7. The tool in accordance with claim 6 wherein said tip is concave.

8. The tool in accordance with claim 7 wherein said tongue is removable.

9. The tool of claim 2 wherein said tongue extends between said parallel members.

10. The tool in accordance with claim 1 wherein said means for gripping is a bar.

11. The tool in accordance with claim 10 wherein said bar is S-shaped.

12. The tool in accordance with claim 1 wherein said means for gripping is a bar having a convex lower end.

13. The tool in accordance with claim 12 wherein said lower end is striated.

14. The tool in accordance with claim 1 wherein an end of said spring contacts said means for gripping.

15. The tool in accordance with claim 14 wherein said first element has a front portion and the other end of said spring contacts said front portion thereby biasing said means for gripping against said lever.

16. The tool in accordance with claim 1 wherein said first element includes a handle.

17. A tool comprising:

(a) a first element having a front portion and a rear portion;

(b) a second element including parallel spaced apart members connected by means for abutment, said second element having an end portion with a tongue;

(c) a lever operably connected to said second element by a second pivot, said lever being adapted to contact said means for abutment;

(d) a means for gripping operably connected to said second element by said first pivot, said means for gripping being in contact with said lever; and (e) at least one spring bent around said first pivot, said spring having an end adapted to contact said lever so as to bias said lever against said means for abutment.

18. The tool in accordance with claim 17, wherein said first element has a rear portion and another end of said spring is adapted to abut said rear portion so as to bias said lever against said means for gripping.

* * * * *